US008408298B2

(12) United States Patent
Briquet et al.

(10) Patent No.: US 8,408,298 B2
(45) **Date of Patent: *Apr. 2, 2013**

(54) DOWNHOLE FLUID FILTER

(75) Inventors: Stephane Briquet, Houston, TX (US); Kevin Zanca, Houston, TX (US); Wade Evans, II, Rosenberg, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/176,974

(22) Filed: Jul. 6, 2011

(65) Prior Publication Data

US 2011/0308787 A1 Dec. 22, 2011

Related U.S. Application Data

(62) Division of application No. 12/363,991, filed on Feb. 2, 2009, now Pat. No. 7,997,341.

(51) Int. Cl.
*E21B 49/10* (2006.01)

(52) U.S. Cl. ..... 166/264; 166/100; 175/58; 73/152.25

(58) Field of Classification Search ..... 166/264, 166/100; 175/58; 73/152.24, 152.25
See application file for complete search history.

(56) References Cited

U.S. PATENT DOCUMENTS 3,352,361 A * 11/1967 Urbanosky ..... 166/100
5,269,180 A * 12/1993 Dave et al. ..... 73/152.06
7,997,341 B2 * 8/2011 Briquet et al. ..... 166/264

* cited by examiner

*Primary Examiner* — Giovanna Wright
*Assistant Examiner* — Catherine Loikith
(74) *Attorney, Agent, or Firm* — John Vereb

(57) ABSTRACT

An apparatus for testing a subterranean formation penetrated by a wellbore is disclosed. The apparatus has a tool with a sample flow line an inlet disposed with the tool and configured to establish fluid communication between the formation and the sample flow line to draw a fluid sample into the sample flow line. An active filter is positionable in the sample flow line and provides a filter flow route and a bypass flow route in the sample flow line.

10 Claims, 6 Drawing Sheets

DOWNHOLE FLUID FILTER

BACKGROUND OF THE DISCLOSURE

Wells are generally drilled into the ground or ocean bed to recover natural deposits of oil and gas, as well as other desirable materials that are trapped in geological formations in the Earth's crust. A well is typically drilled using a drill bit attached to the lower end of a drill string. Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are essential to predicting the production capacity and production lifetime of a subsurface formation.

One technique for measuring formation and reservoir fluid properties includes lowering a wireline tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include a probe that may be pressed against the wellbore wall to establish fluid communication with the formation. This type of wireline tool is often called a formation tester. Using the probe, a formation tester measures the pressure of the formation fluids, which is used to determine the formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a trip uphole. Further, the wireline tools must be lowered to the zone of interest, commonly at or near the bottom of the wellbore. A combination of removing the drill string and lowering the wireline tools downhole are time-consuming measures and can take up to several hours, depending upon the depth of the wellbore. Because of the great expense and rig time required to "trip" the drill pipe and lower the wireline tools down the wellbore, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling).

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568, and 6,964,301.

Reservoir evaluation can be performed on fluids drawn into the downhole tool while the tool remains downhole. Techniques currently exist for performing various measurements, pretests and/or sample collection of fluids that enter the downhole tool. However, it has been discovered that when the formation fluid passes into the downhole tool, various contaminants, such as wellbore fluids and/or drilling mud primarily in the form of mud filtrate from the "invaded zone" of the formation, may enter the tool with the formation fluids. The invaded zone is the portion of the formation radially beyond the mudcake layer lining the wellbore where mud filtrate has penetrated the formation leaving the mudcake layer behind. These mud filtrate contaminates may affect the quality of measurements and/or samples of the formation fluids. Moreover, contamination may cause costly delays in the wellbore operations by requiring additional time for obtaining test results and/or samples representative of the formation fluid. Additionally, such problems may yield false results that are erroneous and/or unusable. Thus, it is desirable that the formation fluid entering into the downhole tool be sufficiently "clean" or "virgin" for valid testing. In other words, the formation fluid should have little or no contamination.

Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid. As shown in U.S. Pat. No. 6,301,959, a probe is provided with a guard ring to divert contaminated fluids away from clean fluid as it enters the probe. More recently, U.S. Pat. No. 7,178,591 discloses a central sample probe with an annular "guard" probe extending about an outer periphery of the sample probe, in an effort to divert contaminated fluids away from the sample probe.

Traditional techniques do not efficiently or effectively address contamination for various subterranean formation types. A common technique to address high contamination, e.g., sand, within the flow line in the tool is to provide a sacrificial sample bottle. For example, a sample bottle that preferably would be utilized for storing a fluid sample is adapted to filter the fluid sample as it is routed through the tool. In some techniques the sacrificial sample bottle may include a screen or other media and/or separation techniques to reduce the contamination in the fluid sample. One of the drawbacks of these systems is the loss of valuable space in the tool as well as that the sacrificial technique merely buys some time for use of the tool downhole. For example, the sacrificial sample chamber will eventually clog, eliminating utilization of the tool.

Despite the existence of techniques for performing formation evaluation and for attempting to deal with contamination, there remains a need to manipulate the flow of fluids through the downhole tool to reduce contamination as the fluid sample passes through the downhole tool. It is desirable that such techniques are capable of diverting contaminants away from contaminant sensitive devices, such as, and without limitation, sensors and pumps. It is also desirable that such techniques be available at one or more positions in a sample tool flow line.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
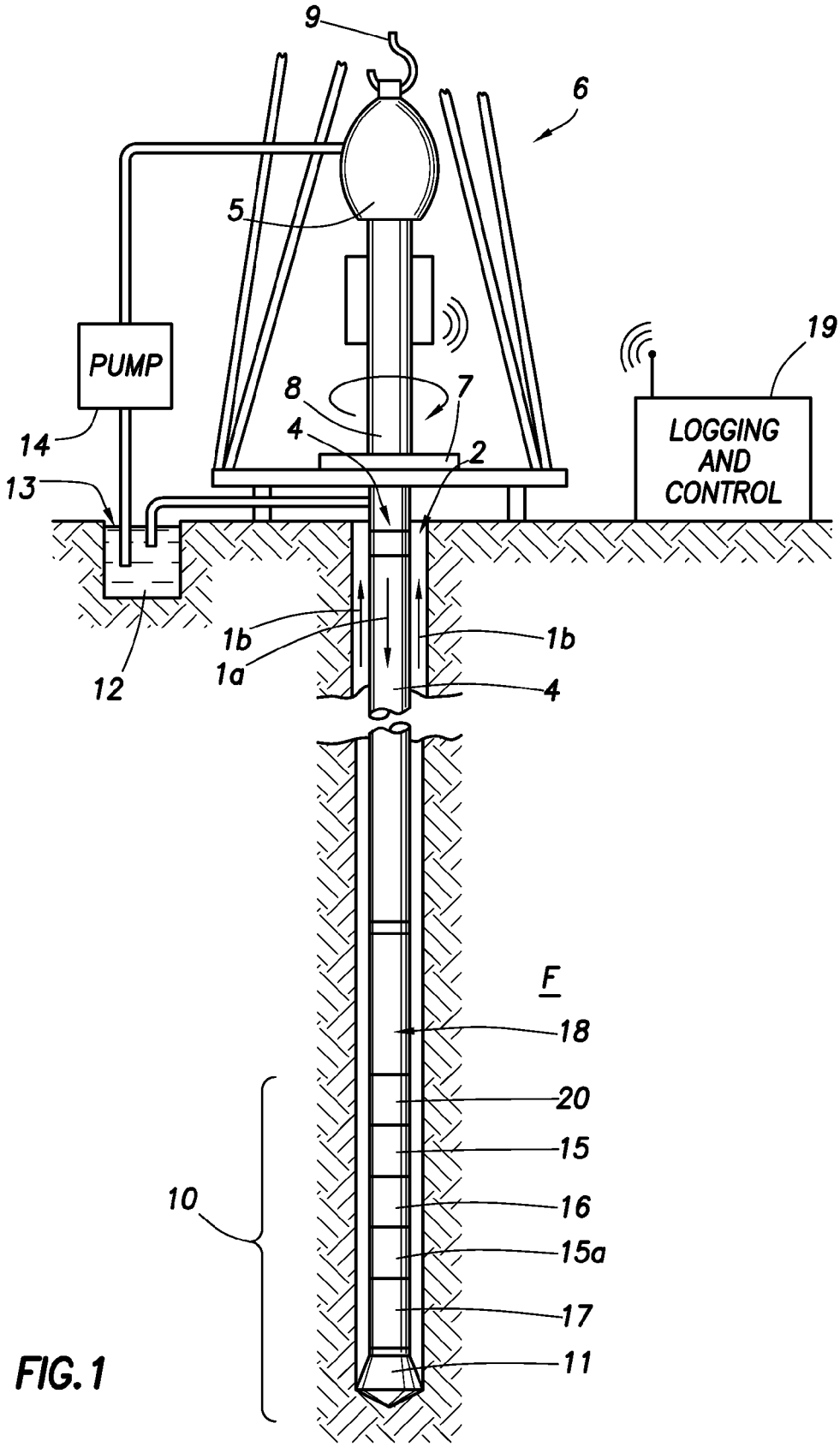
FIG. 1 illustrates an embodiment of a fluid sampling tool of the present disclosure utilized in a drill string.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates a well system in which the present invention can be employed. The well can be onshore or offshore. In this exemplary system, a borehole or wellbore 2 is formed in a subsurface formation(s), generally denoted as F, by rotary drilling in a manner that is well known. Embodiments of the invention can also use directional drilling, as will be described hereinafter.

A drill string 4 is suspended within the wellbore 2 and has a bottomhole assembly 6 which includes a drill bit 11 at its lower end. The surface system includes a deployment assembly 6, such as a platform, derrick, rig, and the like, positioned over wellbore 2. In the embodiment of FIG. 1, assembly 6 includes a rotary table 7, kelly 8, hook 9 and rotary swivel 5. Drill string 4 is rotated by the rotary table 7, energized by means not shown, which engages the kelly 8 at the upper end of the drill string. Drill string 4 is suspended from hook 9, attached to a traveling block (not shown), through kelly 8 and rotary swivel 5 which permits rotation of the drill string relative to the hook. As is well known, a top drive system can alternatively be used.

In the example of this embodiment, the surface system further includes drilling fluid or mud 12 stored in a pit 13 or tank at the well site. A pump 14 delivers drilling fluid 12 to the interior of drill string 4 via a port in swivel 5, causing the drilling fluid to flow downwardly through drill string 4 as indicated by the directional arrow 1*a*. The drilling fluid exits drill string 4 via ports in the drill bit 11, and then circulates upwardly through the annulus region between the outside of the drill string and the wall of the wellbore, as indicated by the directional arrows 1*b*. In this well known manner, the drilling fluid lubricates drill bit 11 and carries formation cuttings up to the surface as it is returned to pit 13 for recirculation.

Bottomhole assembly ("BHA") 10 of the illustrated embodiment includes a logging-while-drilling ("LWD") module 15, a measuring-while-drilling ("MWD") module 16, a roto-steerable system and motor 17, and drill bit 11. LWD module 15 is housed in a special type of drill collar, as is known in the art, and can contain one or a plurality of known types of logging tools. It will also be understood that more than one LWD and/or MWD module can be employed, e.g. as represented generally at 15A. References, throughout, to a module at the position of 15 can alternatively mean a module at the position of 15A as well. LWD module includes capabilities for measuring, processing, and storing information, as well as for communicating with the surface equipment.

MWD module 16 is also housed in a special type of drill collar, as is known in the art, and can contain one or more devices for measuring characteristics of the drill string and drill bit. BHA 10 may further include an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

In this embodiment, BHA 10 includes a subsurface/local communications module or package generally denoted as 18. Communications module 18 can provide a communications link between a controller 19, the downhole tools, sensors and the like. In the illustrated embodiment, controller 19 is an electronics and processing package that can be disposed at the surface. Electronic package and processors for storing, receiving, sending, and/or analyzing data and signals may be provided at one or more of the modules as well.

Controller 19 can be a computer-based system having a central processing unit ("CPU"). The CPU is a microprocessor based CPU operatively coupled to a memory, as well as an input device and an output device. The input device may comprise a variety of devices, such as a keyboard, mouse, voice-recognition unit, touch screen, other input devices, or combinations of such devices. The output device may comprise a visual and/or audio output device, such as a monitor having a graphical user interface. Additionally, the processing may be done on a single device or multiple devices. Controller 19 may further include transmitting and receiving capabilities for inputting or outputting signals. Electronic communications may be provided between various points and devices by various means and methods including without limitation, cables, fiber optics, mud pulse telemetry, and wired pipe.

A particularly advantageous use of the system hereof may be in conjunction with controlled steering or "directional drilling." In this embodiment, a roto-steerable subsystem 17 (FIG. 1) is provided. Directional drilling is the intentional deviation of the wellbore from the path it would naturally take. In other words, directional drilling is the steering of the drill string so that it travels in a desired direction.

In the embodiment illustrated in FIG. 1, BHA 10 further includes a sampling tool, or module, 20 of the present disclosure which is described in further detail below. Although sampling tool 20 may be considered a LWD device or module in some embodiments, it is identified separately herein for purposes of description. Sampling tool 20 may be referred to by various names (e.g., a tool or device, logging tool, formation tester, formation dynamics tester, formation evaluation tool, etc.) without limiting the functionality of tool 20.

Figure 2:
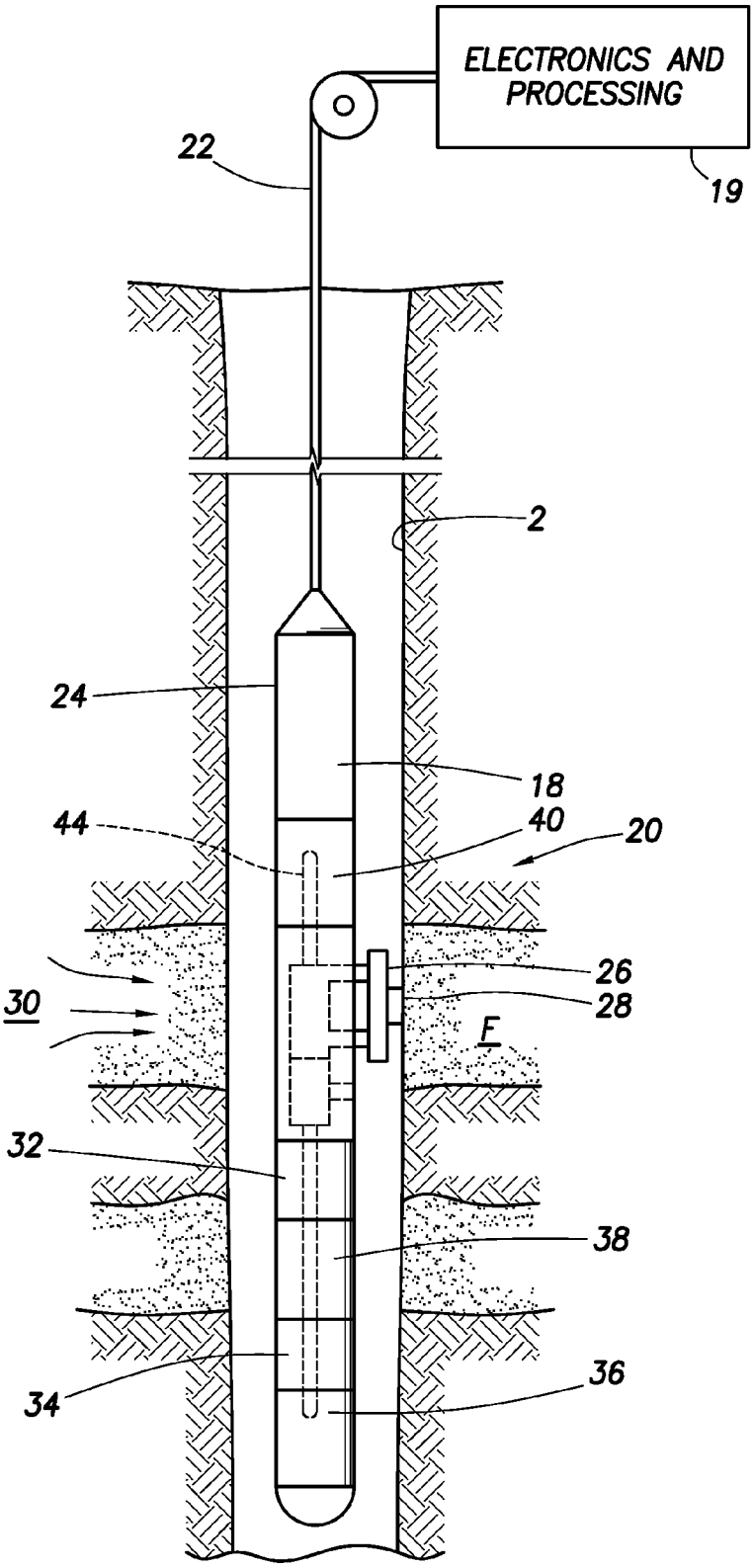
FIG. 2 is schematic view of a fluid sampling tool deployed on a wireline in accordance with an embodiment of the present disclosure.

FIG. 2 illustrates an exemplary embodiment of a sampling tool 20 as deployed in a well as a wireline tool. Commercially available services utilizing, for example, a modular formation dynamics tester ("MDT"—a trademark of Schlumberger), can provide various measurements and samples, as the tool is modularized and can be configured in a number of ways. In some embodiments, sample tool 20 is a modular formation dynamics tester having a filter, or filter module, as further described below.

In the embodiment of FIG. 2, tool 20 is deployed into wellbore 2 on conveyance 22, illustrated as a multiconductor cable, which is spooled at the Earth's surface. At the surface, conveyance 22 may be communicatively coupled to electronics and processing system 19. Tool 20 comprises an elongate body 24 that includes the downhole portion of the device, controls, sample chambers, measurement means, etc. Various systems and functionality will be referred to herein as modules.

Tool 20 may be configured to seal off or isolate one or more portions of a wall of wellbore 2 to fluidly couple to the adjacent formation F and/or to draw fluid samples 30. In the illustrated embodiment, tool 20 includes one or more probe modules 26 that can include an inlet 28, illustrated as a probe in this embodiment, for drawing a fluid sample such as formation fluid 30 into tool 20. Sampling tool 20 may include various other components such as a hydraulic power module 32 to provide hydraulic power to the various modules as required; fluid sample containers 34, 36 that can be connected directly to sampling inlet 26 or via a sample flow line 44; and a pumpout module 38 that can be utilized to purge unwanted fluid and/or to convey fluid through tool 20. Examples of some components and configurations are described in U.S. Pat. No. 7,155,967, which is incorporated herein by reference. In the illustrated example, controller 19 and/or downhole electronics 18 are configured to control operations of sampling tool 20 and/or the drawing of a fluid sample from formation F.

Sampling tool 20 includes a filter system 40 illustrated as a module in the exemplary embodiment of FIG. 2. Filter system 40 is in fluid connection with sample flow line 44 that extends from the sampling inlet 36 of the probe means through tool 20. In this embodiment, filter system 40 provides an active, downhole filter service for sampling tool 20 to protect the contaminant sensitive devices, for example pumpout module 38. Filter system 40 may also facilitate improved accuracy of downhole fluid analysis, e.g. optical fluid analysis, and protect contaminant sensitive devices such as pumps. "Active" is utilized herein to indicate that the filter media may be cleaned, e.g., flushed to the wellbore, over time. In some embodiments, filter system 40 may be bypassed allowing the fluid sample to flow through sampling tool 20 in the traditional manner. As will be further described below, tool 20 may include one or more filter systems 40. In some embodiments, filter system 40 is provided as a module connectable within tool 20 at one or more positions in flow line 44 to address the contamination issues presented and/or to provide protection to various modules of tool 20. As will be noted below, filter system 40 may further include one or more sensors for measuring characteristics of the fluid sample that may be operationally connected with the fluid sample, for example, via in situ ports.

One or more aspects of the present disclosure are directed towards filtering being performed downhole. The filter system 40 may also be placed in locations within the tool 20 other than in the location shown in the exemplary embodiment depicted in FIG. 2. The tool 20 may also comprise more than one filter system 20, including where such filter systems are adjacent each other or separated by other components of the tool 20. For example, one exemplary embodiment may comprise a filter system 20 adjacent or near each pump out module. The tool 20 may also comprise a first filter system 20 for use with a guard probe and a second filter system 20 for use with a sample probe, including where the guard and sample probe are integral to a single probe device.

Figure 3:
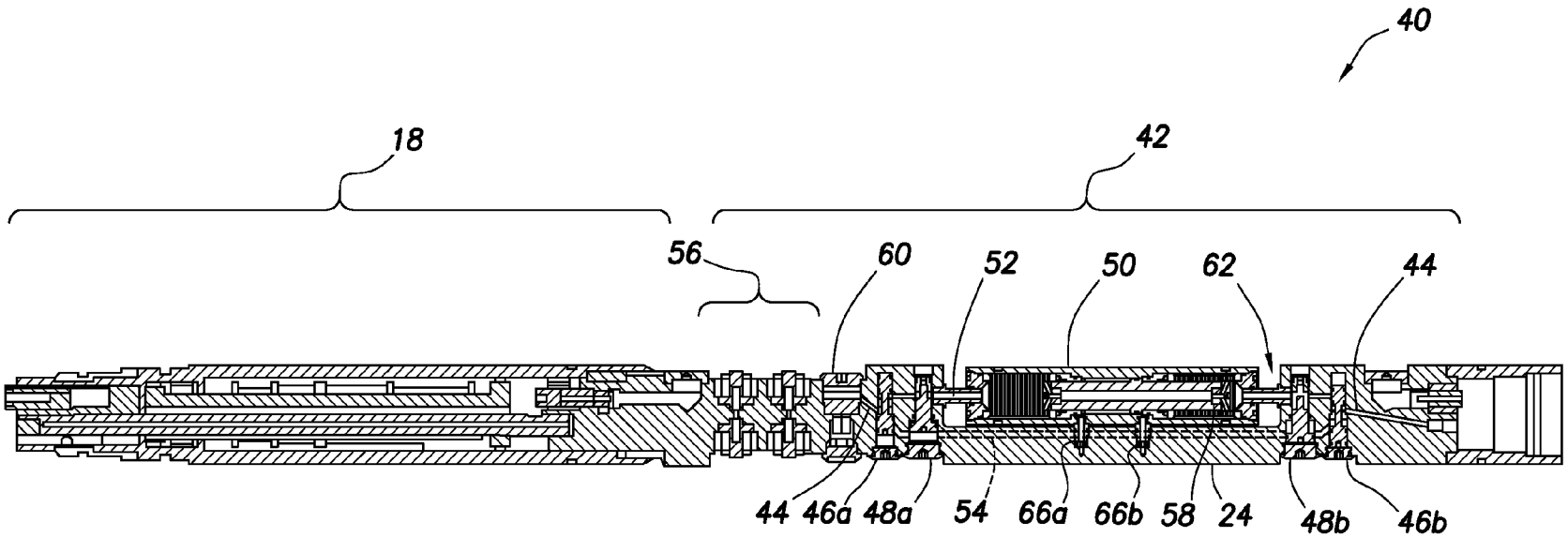
FIG. 3 is a sectional view of a portion of a sampling tool illustrating a filter system in accordance with an embodiment of the present disclosure.

Referring to FIG. 3, a sectional view of a portion of tool 20 illustrating an exemplary embodiment of filter system 40 is provided. Filtering system 40 comprises an active filter 42. Active filter 42 is connected in fluid communication with a sample flow line 44 of tool 20. Sampling flow line, or conduit, 44 as is known in the art is in fluid communication with various components and modules within tool 20. It is noted that active filter 42 may be connected, as desired, in various positions within the sample flow line 44. For example, it may be desired to position active filter 42 upstream of the pumpout module 38 (FIG. 2); upstream or downstream of a sampling chamber; and/or upstream or downstream of one or more fluid analyzers. As is known in the art, flow of the fluid sample through the sampling tool may be provided via the pumpout module, an additional pump or pumpout module, pressure containers, and/or the wellbore pressure.

Active filter 42 further includes one or more valves, illustrated in this embodiment as bypass valves 46*a*, 46*b* and purge valves 48*a*, 48*b*, in fluid communication with sample flow line 44. The valves facilitate routing the fluid sample though filter 50 via filter flow route 52 or a bypass flow route 54.

In some embodiments, such as illustrated in FIG. 3, filter 50 is removeably connected within body 24 in a manner providing immediate access to filter 50. For example, as illustrated in FIG. 3, body 24 provides an open window 62 in which filter 50 is positioned and fluidly connected to flow line 44. Window 62 is open to the exterior providing for easy access if it is desired to remove or change filter 50, for example at the well site before running into the wellbore. As will be described further below, active filter module 42 can be used in a sampling tool without having a filter 50 in place. Further, in some circumstances it may be desired to replace filter 50 with another device. The filter 50 may be changed on the surface for a new one or a different one. Changing the filter 50 for a different one may be performed, for example, to change of the filter element size and/or shape (e.g., smaller slots, different holes, bigger windows, etc.) depending on the type of formation used. The filter 50 could also be changed or reconfigured to become a large passive filter, or to become a separator in gas wells. Other purposes and procedures, however, also exist within the scope of the present disclosure.

Downhole electronics 18 can provide the active sequencing performed via software and/or communicated signals. It is recognized that downhole electronics 18 may be comprised in an omnibus module for the tool or comprise a system dedicated to filtering system 40. In the illustrated embodiment of FIG. 3, downhole electronics 18 can hydraulically sequence valves 46, 48 via solenoids 56. The hydraulic power may be provided via the hydraulic power module 32 (FIG. 2).

As will be described further below, active filter 42 provides for cleaning of filter 50. In some embodiments, cleaning may be provided in part by a hydraulic driven device 58, e.g., a piston. In some embodiments, operation of device 58 may be provided by hydraulic power source 32 (FIG. 2) via solenoids 56 and ports 66*a*, 66*b*.

Sensors may be provided in fluid communication with one or more flow lines. In the illustrated example, in situ port 60 is illustrated for providing communication with one or more sensors and sample flow line 44. The sensors may facilitate measuring and/or identifying, for example and without limitation, hydrogen sulfide, carbon dioxide, density, viscosity and resistivity. The sensors may comprise any combination of conventional and/or future-developed sensors within the scope of the present disclosure.

An exemplary embodiment of a method of operating active filter 42 is provided with specific reference to FIGS. 4A-4D which illustrate an embodiment of active filter 42 in various operational stages.

Figure 4A:
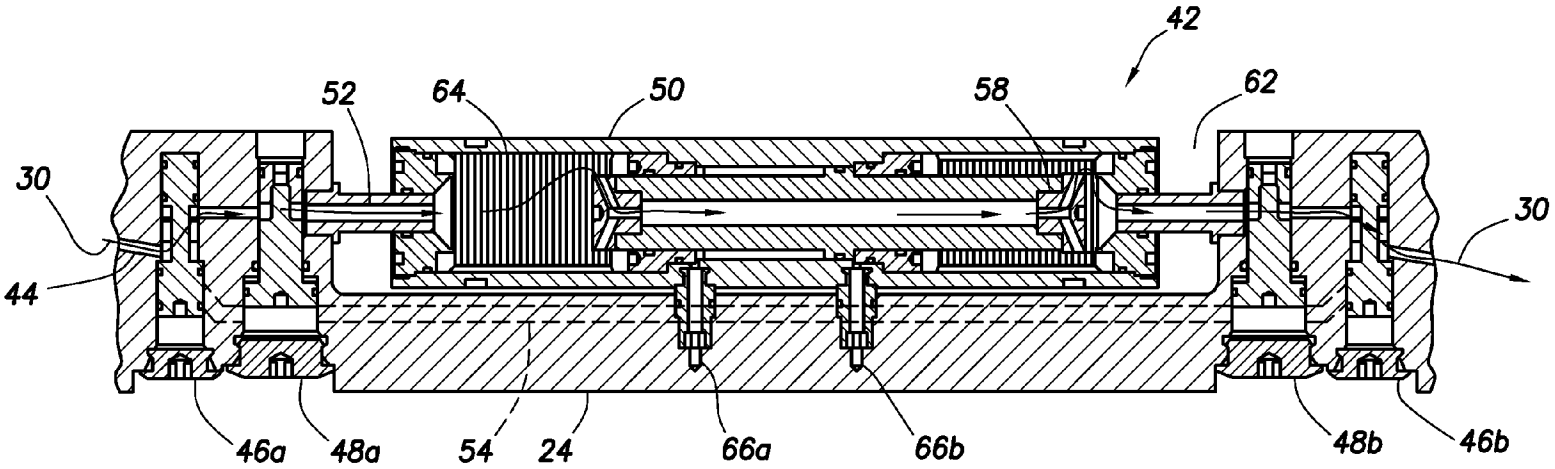
FIGS. 4A-4D are section views of a filter system illustrated in various operational positions in accordance with an embodiment of the present disclosure.

Referring first to FIG. 4A, active filter 42 is shown in the filtering position. Filter 50 is positioned in window 62 of body 24 and in fluid communication with sample flow line 44. Filter 50 includes a filter media 64 and piston 58 for cleaning media 64 and/or discharging material from filter 50. In the illustrated embodiment of FIGS. 4A and 4B, piston 58 is a double acting piston operated by hydraulic power provided via ports 66*a*, 66*b*.

Flow of fluid 30 is provided from sample flow line 44 through either bypass flow route 54 (e.g., a conduit) or filter path 52 of sample flow line 44. Although fluid flow is illustrated in one direction, the direction of the fluid flow can be reversed and/or alternated in various embodiments. For example, FIGS. 4A-4D illustrate a pump down flow but may be operated in pump-up and/or pump down flow.

In FIG. 4A, active filter 42 is illustrated in the filtering position. Purge valves 48*a* and 48*b* are in the closed position blocking fluid flow from filter path 52 to the exterior of body 24 into the wellbore. In some embodiments, purge valves 48 are by default in the closed position. Bypass valves 46*a*, 46*b* are each in the open position permitting fluid sample 30 to flow through filter flow route 52, passing through filter media 64, as shown by the arrows.

Figure 4B:
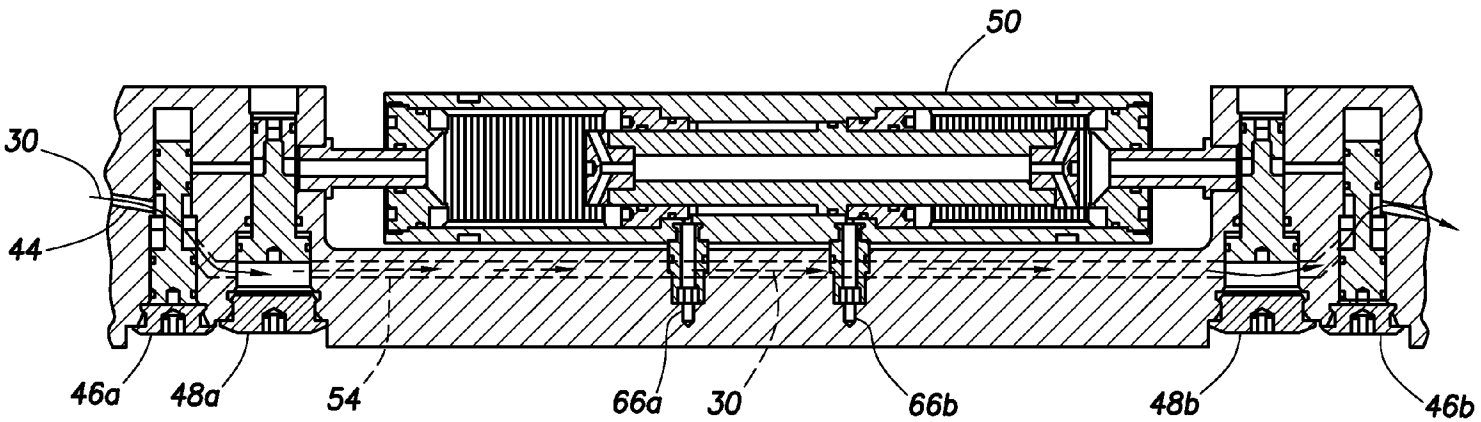

FIG. 4B illustrates active filter 42 in the bypass position. In the bypass position, bypass valve 46*a*, and in the illustrated embodiment bypass valve 46*b*, are moved to the closed position blocking flow of fluid sample flow through filter path 52. "Closed" is utilized herein with reference to bypass valves 46 to mean that flow is blocked from flowing through filter 50. For example, in some embodiments valve 46 may be a three-way valve, or the like, providing one or more positions. Purge valves 48*a* and 48*b* are also shown in the closed position, further isolating filter 50 from the sample flow line 44 and from the wellbore. Active filter 42 may be actuated to the bypass position to allow for the sample tool to be run into the wellbore without filter 50 if desired. Actuation to the bypass mode may also be performed, for example, when filter media 64 is clogged, dirty, and/or filter path 52 is blocked.

Figure 4C:
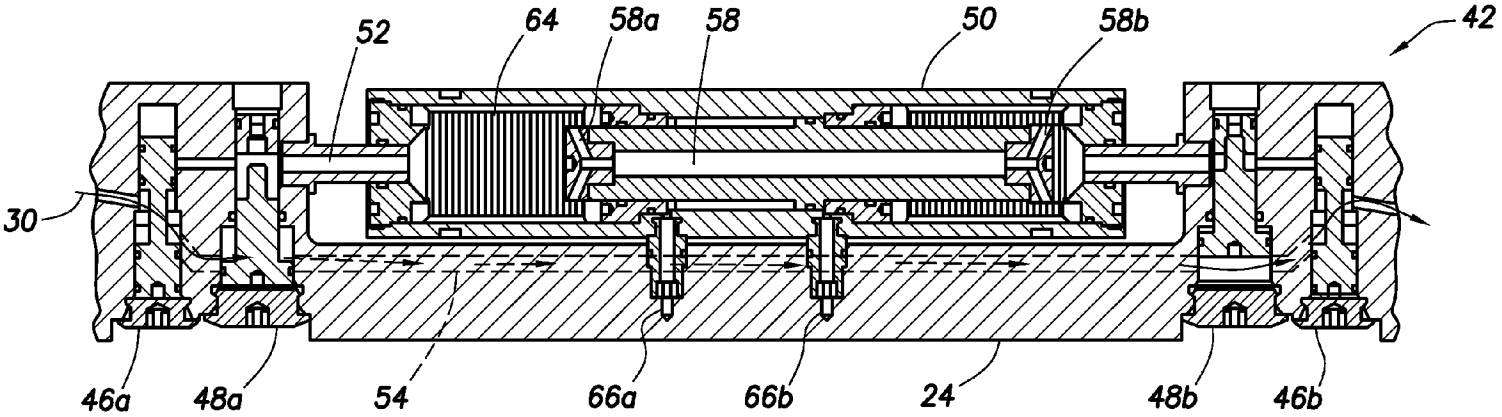
Figure 4D:
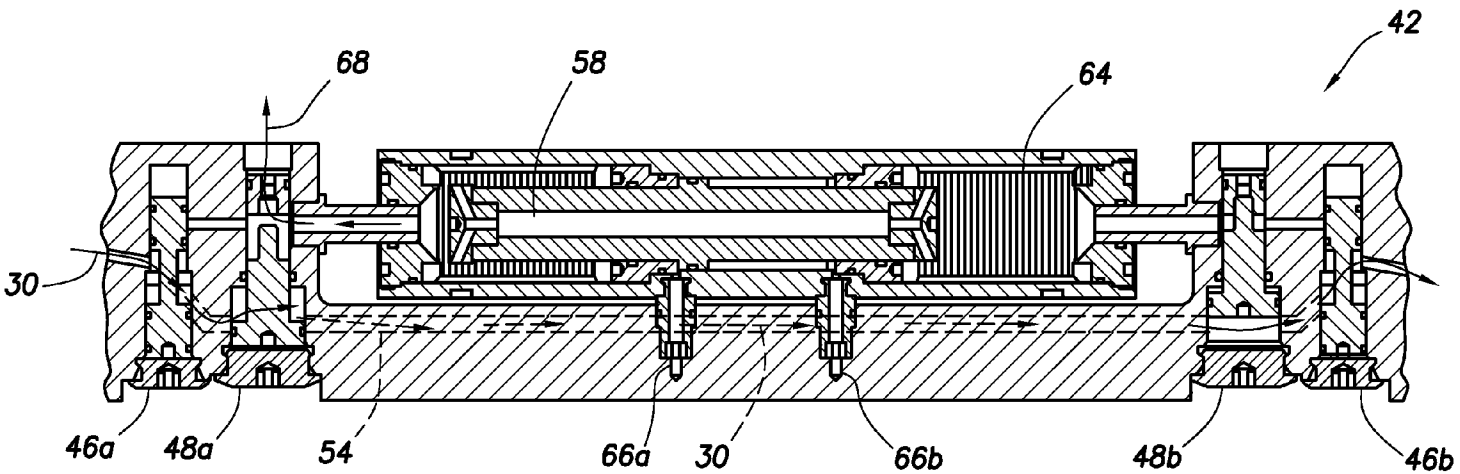

FIGS. 4C and 4D illustrate an exemplary embodiment of operating active filter 42 in a purge or clean mode. In the illustrated embodiments, bypass valves 46*a*, 46*b* are each in the closed position. However, it is noted that in various embodiments one or the other bypass valve may be open or closed. In the illustrated embodiment, piston 58 is dual acting having a first head 58*a* and a second head 58*b* each of which may provide a scraping action along filter media 64.

In FIG. 4C, piston 58 is shown in a first position located toward the right side of filter 50. Purge valve 48*a* is actuated to the open position providing fluid communication between filter 50 (via filter path 52) and the exterior of body 24 (e.g. the wellbore). In the illustrated embodiment, purge valve 48*a* is in the closed position. Fluid sample 30 can bypass filter 50 and flow through bypass flow route 54.

In FIG. 4D, piston 58 is actuated to move toward the open purge valve 48*a*, driving fluid sample and debris contained in filter 50 through purge valve 48*a* into the wellbore as illustrated by the arrow 68. In this embodiment, piston 58 is actuated by providing a fluid under pressure (e.g., hydraulic fluid, pneumatic, etc.) from hydraulic power source 32 (FIG. 2) through port 66*a*. Piston 58 may be moved back toward the first position by opening purge port 48*b* and routing hydraulic power through port 66*b*.

Figure 5A:
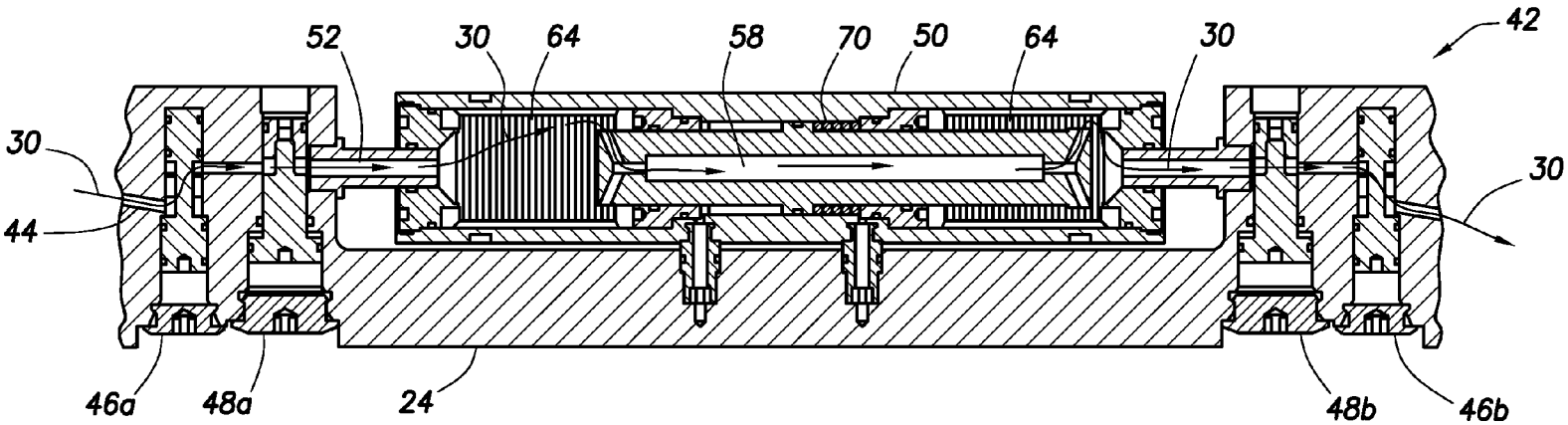
FIGS. 5A and 5B are sectional views of a filter system illustrated in operational positions in accordance with another embodiment of the present disclosure.
Figure 5B:
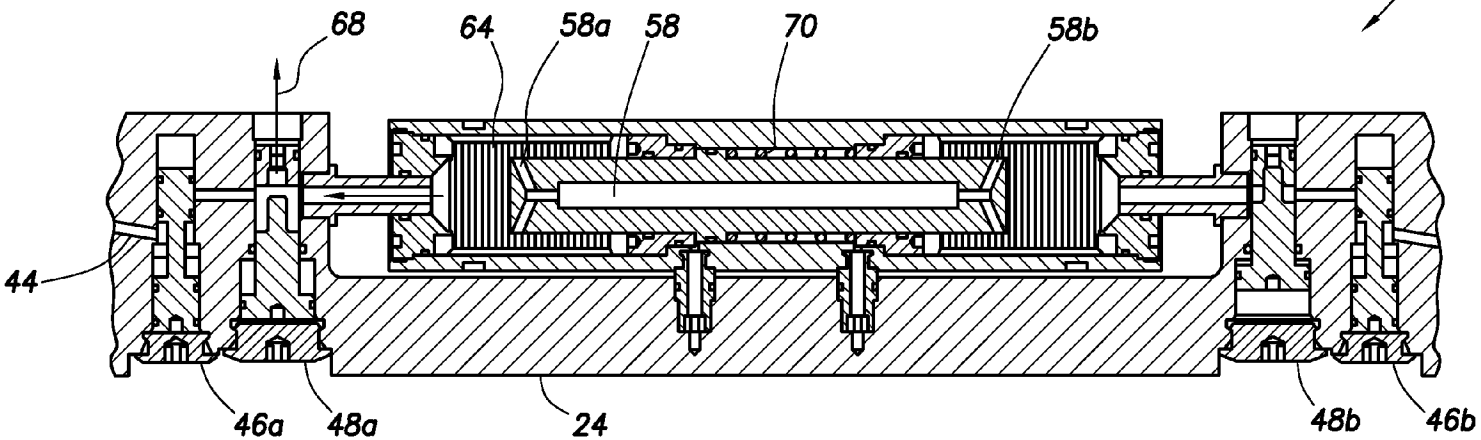

Refer now to FIGS. 5A and 5B wherein another embodiment of active filter 42 is illustrated. In this embodiment, piston 58 is not powered from an external hydraulic source. Thus, although ports 66*a*, 66*b* are illustrated in FIGS. 5A and 5B they may be inactive or not operationally connected to filter 50. Filter 50 includes piston 58 and a biasing mechanism 70, shown as a spring, in operational connection with piston 58.

Active filter 42 is shown in the filtering position in FIG. 5A and described with fluid 30 being pumped from the left to the right. Bypass valve 46*a*, 46*b* are open allowing fluid 30 to flow through filter path 52. As fluid 30 flows through filter path 52 and filter media 64, for example, it imparts hydraulic pressure on piston 58. The hydraulic pressure acting on piston 58 urges it in the direction of the fluid flow and compresses biasing mechanism 70 (e.g., in the filtering position).

One example of purging and/or cleaning filter 50 is now described with reference to FIG. 5B. Continuing from the filtering position of FIG. 5A, bypass valve 46*a* is moved to the closed position and purge valve 48*a* is open. Biasing mechanism 70 then urges piston back toward the default, resting position; scrapping filter media 64 and/or flushing fluid out of open purge valve 48*a* into the wellbore as illustrated by the numeral 68.

In view of all of the above and the Figures, those skilled in the art should readily recognize that the present disclosure introduces an apparatus for testing a subterranean formation penetrated by a wellbore, comprising a tool having a sample flow line probe means disposed with the tool for establishing fluid communication between the formation and the sample flow line to draw a fluid sample into the sample flow line, and an active filter positioned in the sample flow line, the active filter providing a filter flow route and a bypass flow route in the sample flow line.

The present disclosure also introduces a module connectable within a formation testing tool that has a sample flow line extending from a fluid sampling inlet to draw a fluid sample from a wellbore and/or subterranean formation into the sample flow line, the module comprising: a body forming a filter flow route and a bypass flow route in the sample flow line when connected within the tool; a filter connected within the filter flow route; a bypass valve in fluid connection with the filter flow route and the bypass flow route, wherein the bypass valve is operable between a filter position routing the fluid sample through the filter flow route and a bypass position routing the fluid sample through the bypass flow route; a purge valve in fluid connection with the filter flow route, the purge valve operable between an open position providing fluid communication between the filter flow route and exterior of the body and a closed position blocking the fluid communication; and a device moveably disposed with the filter, the device expelling the fluid sample from the filter when moved toward the purge valve in the open position.

The present disclosure also introduces a method for testing a subterranean formation, the method comprising: providing a tool having a sample flow line; providing a filter module in the tool, the filter module having a filter flow route and a bypass flow route in fluid communication with the sample flow line, the filter flow route including a filter; deploying the tool in the wellbore; drawing a fluid sample into the sample flow line; filtering the fluid sample by routing the fluid sample through the filter flow route; bypassing the filter by routing the fluid sample through the bypass flow route; and purging the filter to the wellbore.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A wellbore tool comprising:

a sampling inlet configured to draw a fluid sample from a wellbore or a subterranean formation, the sampling inlet positioned in a first module;

a filter flow route in a second module, the filter flow route in fluid communication with the sampling inlet, wherein the first module and the second module are spaced apart from one another and separable;

a filter connected within the filter flow route;

a device movable between a filtering position in which the fluid sample flows through the filter and a resting position where substantially none of the fluid sample passes through the filter;

a first fluid port directing fluid to move the device in a first direction toward the filtering position; and a second fluid port directing fluid to move the device in a second direction toward the resting position, wherein the first fluid port and the second fluid port are openable and closable to move the device.

2. The module of claim 1 further comprising a purge valve operable between:

an open position providing fluid communication between the filter flow route and exterior of the body; and a closed position blocking the fluid communication.

3. The module of claim 2 wherein the device is configured to expel the fluid sample from the filter when moved toward the purge valve in the open position.

4. The module of claim 3 further comprising a biasing member urging the device toward the purge valve.

5. The module of claim 4 wherein the device is urged away from the purge valve when the fluid sample is flowing through the filter flow route.

6. The module of claim 1 wherein the body forms an open window and the filter is positioned in the window when connected within the filter flow route.

7. The module of claim 1 wherein the body further comprises ports in operational connection with the sample flow line for connecting a fluid characteristic sensor.

8. The module of claim 1 wherein the formation tester tool is configured for conveyance within the wellbore by at least one of a wireline and a drill string.

9. An apparatus, comprising:

a downhole tool comprising a first module comprising an inlet, wherein the inlet is configured to:

establish fluid communication with the subterranean formation; and draw a fluid sample from the subterranean formation into a sample flow line of the downhole tool;

a second module comprising an active filter, wherein the active filter comprises:

a filter flow route comprising a filter configured to filter sampled subterranean formation fluid received from the inlet via the sample flow line;

a device configured to remove contamination from the filter, wherein the device is movable from a first position to a second position based on movement of the fluid sample overcoming a biasing form against the device biasing the device toward the first position, and wherein the device is movable within the filter based on force from a biasing member to move the device from the second position to the first position to expel fluid from the filter and/or scrape a filter media off the filter, and further wherein the fluid sample passes through the filter if the device is at the second position and is substantially prevented from passing through the filter at the first position.

10. The apparatus of claim 9 wherein the plurality of modules is configured for conveyance within the wellbore by at least one of a wireline and a drill string.

* * * * *